US009113693B2

(12) United States Patent
Yan

(10) Patent No.: US 9,113,693 B2
(45) Date of Patent: Aug. 25, 2015

(54) MECHANISM FOR DEPLOYING A STICK OF COSMETIC PRODUCT, ASSOCIATED DEVICE AND PROCESS

(75) Inventor: Jian Yan, Shanghai (CN)

(73) Assignee: L'OREAL, Paris (FR)

( * ) Notice: Subject to any disclaimer, the term of this patent is extended or adjusted under 35 U.S.C. 154(b) by 486 days.

(21) Appl. No.: 13/520,711

(22) PCT Filed: Jan. 12, 2010

(86) PCT No.: PCT/CN2010/000047
§ 371 (c)(1),
(2), (4) Date: Sep. 25, 2012

(87) PCT Pub. No.: WO2011/085511
PCT Pub. Date: Jul. 21, 2011

(65) Prior Publication Data

US 2013/0022384 A1 Jan. 24, 2013

(51) Int. Cl.
*B43K 21/08* (2006.01)
*A45D 40/06* (2006.01)

(52) U.S. Cl.
CPC ..... *A45D 40/06* (2013.01); *Y10T 29/49826* (2015.01)

(58) Field of Classification Search
CPC ..... A45D 40/06
USPC ..... 401/68, 75, 77, 78; 132/318
See application file for complete search history.

(56) References Cited

U.S. PATENT DOCUMENTS

| | | | | |
|---|---|---|---|---|
| 2,858,937 | A | 11/1958 | Hoffman | |
| 2,913,103 | A | 11/1959 | Isele | |
| 3,438,714 | A * | 4/1969 | Seaver | 401/78 |
| 5,399,040 | A * | 3/1995 | Holloway | 401/78 |
| 5,636,930 | A * | 6/1997 | Holloway | 401/78 |
| 5,649,777 | A * | 7/1997 | Holloway | 401/78 |
| 5,842,805 | A | 12/1998 | Pierpont | |
| 5,873,379 | A * | 2/1999 | Bouix | 132/318 |
| 5,876,137 | A | 3/1999 | Byrd | |
| 5,899,620 | A | 5/1999 | Pierpont | |
| 5,984,552 | A * | 11/1999 | Ackermann et al. | 401/74 |
| 5,988,917 | A * | 11/1999 | Sheffler et al. | 401/78 |
| 6,312,179 | B1 | 11/2001 | Gueret | |

FOREIGN PATENT DOCUMENTS

| | | |
|---|---|---|
| CN | 2196924 Y | 5/1995 |
| CN | 1216241 A | 5/1999 |
| CN | 1226411 A | 8/1999 |

(Continued)

*Primary Examiner* — Jennifer C Chiang
(74) *Attorney, Agent, or Firm* — Novak Druce Connolly Bove + Quigg LLP

(57) ABSTRACT

The mechanism comprises an inner hollow sleeve (60) and an outer sleeve (62) rotatably mounted around the inner sleeve (60). The outer sleeve (62) delimits an helical track (105), the inner sleeve (60) delimiting an axial track (72) intersecting the helical track (105). The mechanism comprises a cup (64) for holding the stick (12). The cup (64) is able to be actuated from an initial configuration, in which its axial movement between a retracted inner position and a deployed outer position is prevented when the inner sleeve (60) is rotated relative to the outer sleeve (62), and a use configuration, in which relative rotation between the inner sleeve (60) and the outer sleeve (62) induces an axial movement of the cup (64) between its inner retracted position and its outer deployed position.

14 Claims, 8 Drawing Sheets

(56) References Cited

FOREIGN PATENT DOCUMENTS

| | | | |
|---|---|---|---|
| CN | 2356552 | Y | 1/2000 |
| CN | 2827096 | Y | 10/2006 |
| EP | 0428794 | A1 | 5/1991 |
| FR | 1172681 | A | 2/1959 |
| GB | 798044 | A | 7/1958 |
| GB | 853306 | A | 11/1960 |
| WO | WO-95/01743 | A1 | 1/1995 |

* cited by examiner

MECHANISM FOR DEPLOYING A STICK OF COSMETIC PRODUCT, ASSOCIATED DEVICE AND PROCESS

PRIORITY

Priority is claimed as a national stage application, under 35 U.S.C. §371, to PCT/CN2010/000047, filed Dec. Jan. 12, 2010. The disclosure of the aforementioned priority application is incorporated herein by reference in its entirety.

The present invention relates to a mechanism for deploying a stick of cosmetic product, comprising:

an inner hollow sleeve having a longitudinal axis;

an outer sleeve rotatably mounted around the inner sleeve, one element among the inner sleeve and the outer sleeve delimiting an helical track, the other element among the inner sleeve and the outer sleeve delimiting an axial track intersecting the helical track;

a cup for holding the stick, the cup having a protrusion engaged in the helical track and in the axial track, the cup being axially movable within the inner sleeve between an inner retracted position and an outer deployed position.

A cosmetic product is in particular a product as defined in Directive 93/35 EEC of the Council, dated Jun. 14, 1993.

The cosmetic product is advantageously a pasty product in the form of a stick which is self supporting. The stick is advantageously a product for make-up of the skin and/or the keratinic fibers of a user. In particular, the stick is a lipstick intended to be deposited on the lips of the user to cover at least partially the lips.

The mechanism is intended to be removably mounted in a hollow base of a holding device or casing. A cover is usually engaged around the hollow base to cover the mechanism when the device is stored, for example in the hand bag of a user.

Known devices of this type are disclosed in U.S. Pat. No. 6,312,179, U.S. Pat. No. 2,858,937, U.S. Pat. No. 2,913,103, FR 1 172 681, GB-853 306, EP 0 428 794.

When the mechanism is mounted in the hollow base, the hollow base usually engages the inner sleeve of the mechanism, to be jointly movable with the inner sleeve in rotation relative to the outer sleeve.

Before using the stick of cosmetic product, the user opens the cover. Then, the user seizes the outer sleeve with one hand and the hollow base with the other hand. The user subsequently rotates the hollow base relative to the outer sleeve to deploy the stick out of the mechanism.

The mechanism being removable, it is possible to replace it by another similar mechanism after the stick is depleted or when the user wishes to use a different stick, e.g. with a different color.

Such a device is therefore economical and allows for a great flexibility of use.

However, this device is not entirely satisfactory. Indeed, the mechanism being supplied independently of the hollow base, there is a possibility that the inner sleeve is accidentally rotated around the outer sleeve before the mechanism is inserted in the hollow base.

The uncontrolled rotation of the inner sleeve with regard to the outer sleeve can lead to a deployment of the stick outside of the inner sleeve, with potential drawbacks such as breaking the stick and/or pollution of the hand bag carrying the mechanism.

In order to overcome this difficulty, WO 95/01743 discloses a removable stick deployment mechanism, in which access to the rotating knob of the inner sleeve is hindered by provision of an external protection skirt delimited on the outer sleeve. As a consequence, the inner sleeve is almost entirely covered by the outer sleeve. This restricts access to the inner sleeve and reduces the risk of accidental deployment of the stick.

This solution is however not entirely satisfactory. Indeed, rotation of the stick remains possible by accessing axially through the lower opening in the outer sleeve.

Moreover, the hollow base must be devised to accommodate the protection skirt of the outer sleeve, which complicates its structure and increases its cost.

An object of the invention is therefore to provide a removable stick deployment mechanism which can be safely handled before its first use, and which can be easily used upon insertion of the mechanism in a holding device.

Another object of the invention is to provide such a stick deployment mechanism with a low cost and a simple structure.

To that end, the invention relates to a mechanism of the above-mentioned type, characterized in that the cup is able to be actuated upon insertion of the mechanism in the hollow base, from an initial configuration, in which its axial movement between the retracted inner position and the deployed outer position is prevented when the inner sleeve is rotated relative to the outer sleeve about any angle of relative rotation, and a use configuration, in which relative rotation between the inner sleeve and the outer sleeve beyond a given angle of relative rotation induces an axial movement of the cup between its inner retracted position and its outer deployed position.

The mechanism according to the invention can comprise one or more of the following feature(s), taken in isolation or in any technical possible combination(s):

the cup is axially movable relative to the inner sleeve and to the outer sleeve along the longitudinal axis between the initial configuration and the use configuration;

the mechanism comprises preventing means for preventing the axial displacement of the cup between its inner retracted configuration and its outer deployed position, the preventing means cooperating with the cup in the initial configuration;

the helical track comprises a first helical region in which rotation of the inner sleeve relative to the outer sleeve induces axial displacement of the cup when the protrusion is received in the first region, the preventing means comprising a second retaining region of the helical track in which rotation of the inner sleeve relative to the outer sleeve about any angle of relative rotation maintains the axial position of the cup when the protrusion is received in the second region;

the helical track is delimited by a lower edge, the lower edge being inclined relative to the longitudinal axis in the first region, the lower edge extending approximately axially in the second region;

the second region is located at the lower end of the first region;

the mechanism comprises guiding means for guiding the cup between its initial configuration and its use configuration;

the guiding means comprise a guiding region of the axial track able to drive the protrusion from the second region of the helical track to the first region of the helical track when the cup is moved from its initial configuration to its use configuration;

the axial track comprises a main axial region extending in a first axial direction, a lower transverse region extending transversely relative to the main axial region, the guiding region extending axially in a second axial direction from the lower transverse region.

The invention also relates to a device for holding a stick of cosmetic product comprising:

a hollow support base defining a cavity;

a mechanism as defined above, the mechanism being movable relative to the hollow base between a position apart from the hollow base and a position inserted in the cavity of the hollow base, the cup being actuated between its initial configuration and its use configuration upon insertion of the mechanism in the cavity of the hollow base.

The device according to the invention can comprise one or more of the following features, taken in isolation or in any technically possible combination(s):

the hollow base comprises an actuating projection able to engage one element among the cup, the inner sleeve and the outer sleeve to induce a relative movement between the cup, and at least one of the inner sleeve and the outer sleeve, to actuate the cup from its initial configuration to its use configuration;

the actuating projection contacts the cup upon insertion of the mechanism in the hollow base to move the cup between its initial configuration and its use configuration;

one among the inner sleeve and the outer sleeve comprises a knob, the hollow base defining an actuating surface able to engage the knob when the mechanism is inserted in the hollow base, the hollow base and the one among the inner sleeve and the outer sleeve being jointly movable in rotation around the longitudinal axis relative to the other among of the inner sleeve and the outer sleeve;

the device comprises a removable cover engageable on the hollow base, the cover and the hollow base defining an inner space receiving the mechanism.

The invention additionally relates to a process for preparing a stick of cosmetic product in order to apply the cosmetic product on a body surface of a user, comprising the following steps:

provision of a device as defined above, the mechanism being in its position apart from the hollow base, the cup being in its initial configuration in which its axial movement between its inner retracted position and its outer deployed position is prevented;

insertion of the mechanism in the cavity of the hollow base, the insertion inducing the actuation of the cup from its initial configuration to its use configuration;

relative rotation between the inner sleeve and the outer sleeve around the longitudinal axis to induce an axial sliding of the cup between its inner retracted position and its outer deployed position.

The invention will be better understood upon reading the following description, which is given solely by way of example and with reference to the accompanying drawings, in which.

Figure 1:
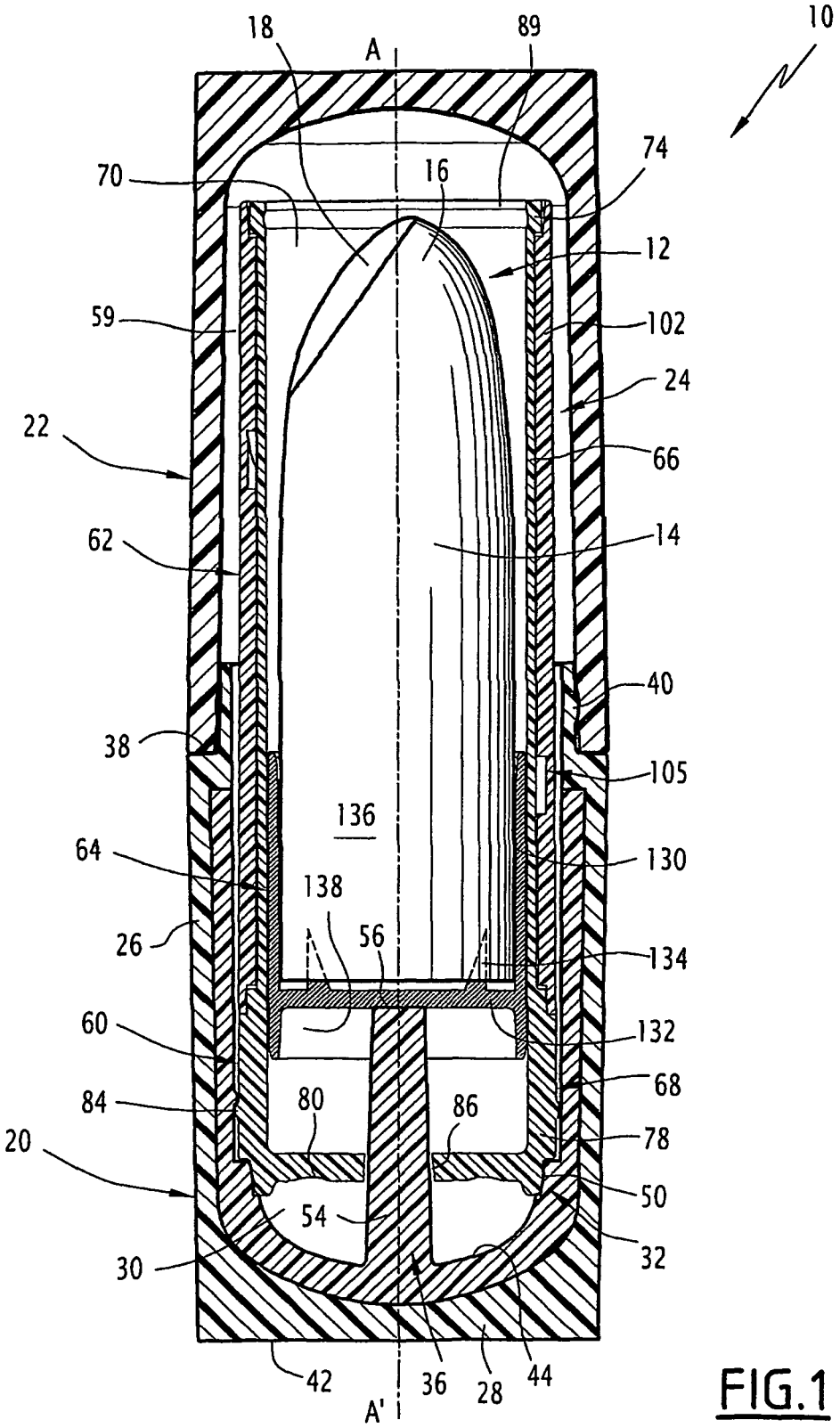
FIG. 1 is a section view, taken according to an axial median plane, illustrating a first device according to the invention, the mechanism being loaded in the hollow base.

In the following description, the orientations must be understood relative to the representation on the Figures.

A first device 10 for holding a stick 12 of cosmetic product according to the invention is shown in FIGS. 1 to 9. The device 10 generally extends along a longitudinal axis A-A' which is vertical in FIG. 1.

The cosmetic product is advantageously a pasty product which is intended to be applied on a body surface of a user. The body surface is for example a keratinic fiber or the skin of a user, in particular a tissue such as the lips.

The stick 12 is formed by a self-supporting block of cosmetic product.

Upon contact with the body surface of the user, a superficial area of the stick is able to be deposited on the body surface.

The product is advantageously a lipstick, potentially with a color, or uncolored.

Before its first use, the stick 12 has a general bullet shape with a cylindrical base 14 and a tapered upper end 16, having potentially a flat 18.

The holding device 10 comprises a hollow base 20, a removable cover 22, and a mechanism 24 for storing and deploying the stick. According to the invention, the mechanism 24 is removable from the hollow base 20 as will be explained in details below.

Figure 2:
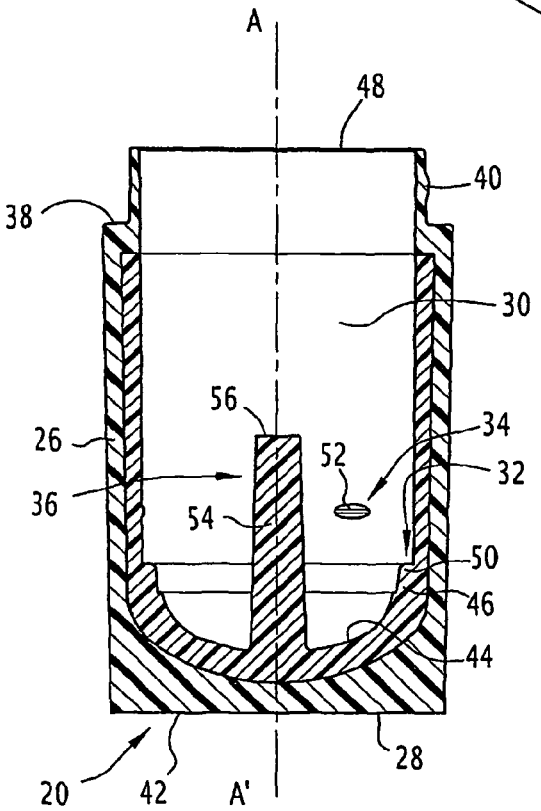
FIG. 2 is a section view, taken along the same median axial plane, of the hollow base member of the device shown in FIG. 1.

As shown in FIGS. 1 and 2, the hollow base 20 comprises a lateral wall 26, a bottom wall 28, the lateral wall 26 and the bottom wall 28 defining an insertion cavity 30 for receiving the mechanism 24.

The hollow base 20 also comprises gripping elements 32 for gripping the mechanism 24 and retaining elements 34 for axially retaining the mechanism 24 inside the cavity 30.

According to the invention, the hollow base 20 also comprises an axial projection 36 for activating the mechanism 24 as will be described below.

The lateral wall 26 is generally tubular, for example cylindrical around the axis A-A'. It defines, around its upper end, an outer shoulder 38 for supporting the cover 22 and a plurality of retaining spuds 40, which protrude radially form the outer surface of the lateral wall 26 above the annular outer shoulder 38.

The lateral wall 26 and the bottom wall. 28 define an outer surface of the device 10.

The bottom wall 28 defines a flat lower surface 42 for laying the device 10 in an upright position and a concave inner surface 44 defining the bottom of cavity 30. The bottom wall 28 and the lateral wall 26 define an inner shoulder 46 located inside cavity 30, along the lower edge of the peripheral wall 26.

The cavity 30 is laterally delimited by lateral wall 26 and is axially delimited downwardly by the inner surface 44 of the bottom wall 28.

The cavity 30 opens out upwardly through an upper opening 48 for insertion of the mechanism 24.

The gripping elements 32 comprise several teeth 50 which are angularly distributed around axis A-A'. Each tooth 50 protrudes radially towards the axis A-A' inside cavity 30 above the inner shoulder 46. In the example shown, the hollow base 20 comprises four teeth 50 angularly separated by approximately 90°.

The retaining elements 34 are formed by radial bulges 52 which protrude radially inside cavity 30 on the inner surface of the lateral wall 26.

The bulges 22 are located above the teeth 50 and are distributed angularly around the axis A-A'. The radial thickness of each bulge 52 is lower than the radial thickness of the wall 26, to allow a removal of the mechanism 24 when the stick 12 is depleted.

The actuating projection 36 is formed by an elongate pin 54. The elongate pin 54 protrudes axially inside cavity 30 along axis A-A' from the concave inner surface 44 of the bottom wall 28.

The elongate pin 54 has an upper transverse surface 56 intended to cooperate with the mechanism 24. The upper surface 56 is located above the retaining elements 34 and below the outer shoulder 38 and the upper opening 48. The height of the pin 54, taken along the axis A-A' is generally comprised between 0.2 times and 0.5 times the maximum height of cavity 30, taken along the axis A-A'.

The cover 12 defines an upper cavity 59 able to receive the upper portion of the mechanism 24.

The mechanism 24 is removably mounted in the hollow base 20. It is movable relative to the hollow base 20 between a position located apart from the hollow base 20, outside of cavity 30, and a position in which the mechanism 24 has been inserted inside cavity 30 through the upper opening 48.

Figure 3:
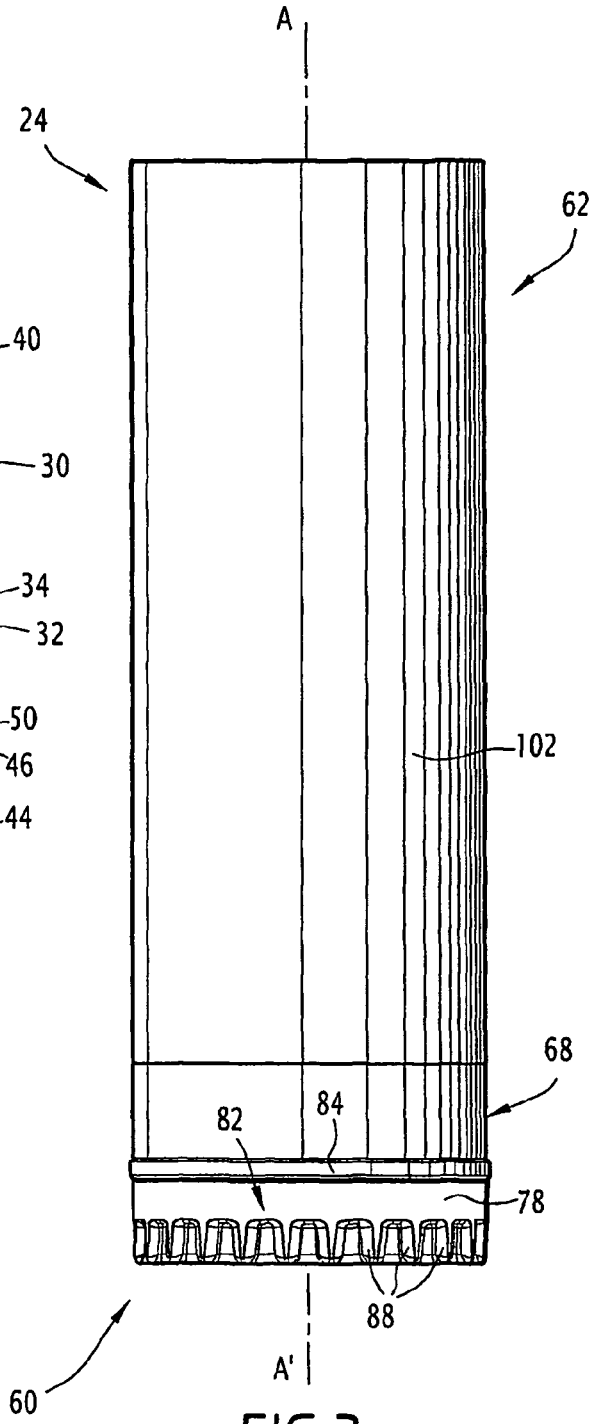
FIG. 3 is a front view of the mechanism of the device shown in FIG. 1.
Figure 4:
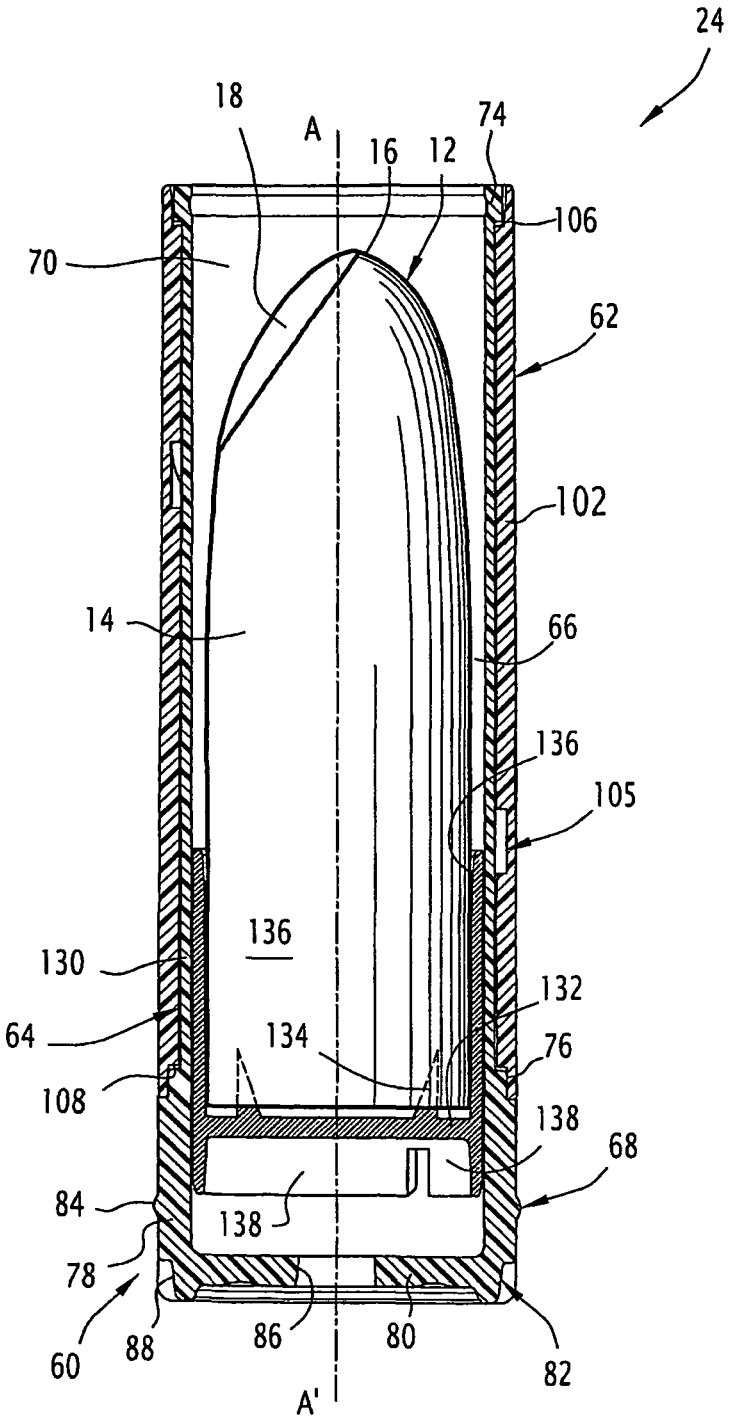
FIG. 4 is a section, taken along an axial median plane, illustrating the mechanism of FIG. 3, before its first introduction in the hollow base of FIG. 2.

As illustrated in FIGS. 1, 3 and 4, the mechanism 24 comprises an inner sleeve 60, an outer sleeve 62 mounted rotatably around axis A-A' around the inner sleeve 60 and a cup 64 having a guiding lug 65, the cup 64 being slidable axially inside the inner sleeve 60.

The inner sleeve 60 extends generally along axis A-A'. It comprises a tubular upper wall 66 and a lower knob 68 intended to be gripped by the hollow base 20.

Figure 5:
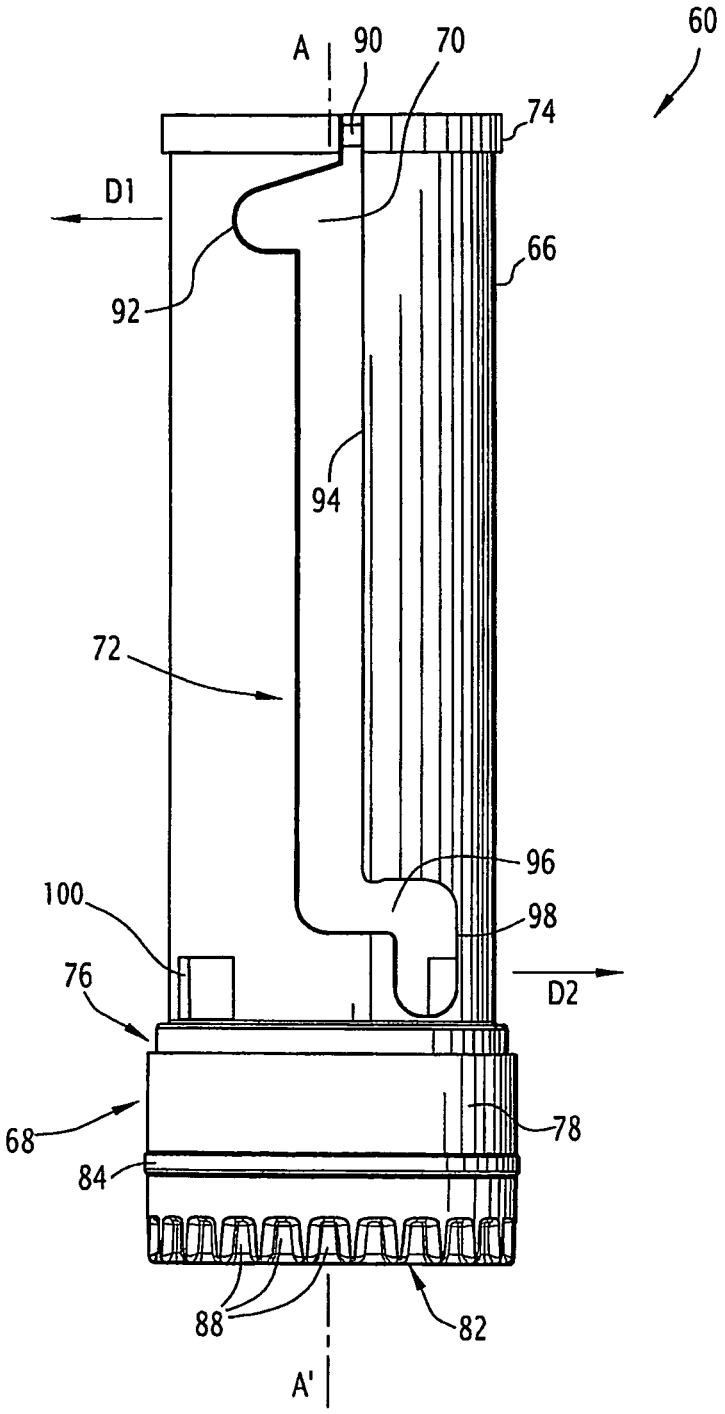
FIG. 5 is a front view of the inner sleeve of the mechanism of FIG. 3.

The inner sleeve 60 defines an inside lumen 70 for the sliding of the cup 64 and a sliding axial track 72, visible in FIG. 5, for guiding the movement of cup 64 inside the lumen 70.

The mechanism 24 has a total height, taken along axis A-A', which is higher than the height of the stick 12. The height of mechanism 24 is at least 1.2 times higher than the height of the stick 12 before its first use.

The tubular wall 66 has a height which is approximately equal to the height of the stick 12 before its first use. It extends axially between the knob 68 and an upper collar 74 defined at its upper end.

The upper collar 74 protrudes radially away from axis A-A'.

The knob 68 has a height which is lower than the height of the tubular wall 66. The tubular wall 66 and the knob 68 define an outer annular step 76 for rotatably supporting the outer sleeve 62.

The knob 68 comprises a peripheral wall 78, a transverse bottom wall 80, corrugations 82 and an annular rib 84 for cooperating with the hollow base 20.

The transverse bottom wall 80 defines a central opening 86 for insertion of the actuating projection 36 inside the lumen 70.

The corrugations 82 extend around the bottom edge of the peripheral wall 78. The corrugations 82 define a series of axial adjacent notches 88 which open downwardly. Each notch 88 has a shape complementary to the shape of a tooth 50. When the mechanism 24 occupies its inserted position, each tooth 50 is therefore complementary received in a complementary notch 88 for mutual engagement.

The annular rib 84 extends around axis A-A'. The rib 84 is intended to cooperate with the retaining elements 34 which are applied on and above rib 84 when the mechanism 24 occupies its position inserted inside the hollow base 20.

The lumen 70 is laterally delimited by the tubular wall 66 and transversely delimited by the transverse wall 80.

It opens upwardly through an extraction opening 89 delimited by the collar 74 at the top edge of tubular wall 66. The lumen 70 also opens downwardly through the central opening 86 defined in the transverse wall 80.

As illustrated in FIG. 5, the axial guiding track 72 is formed by a slot extending through the upper tubular wall 66. The track 72 comprises an upper slit 90 for insertion of the cup 64 inside the lumen 70, an upper transverse region 92, an intermediate axial region 94, a lower transverse region 96, and a lower guiding axial region 98.

The upper slit 90 splits the upper collar 74. It opens upwardly and it opens downwardly in the upper transverse region 92.

At rest, the width of the slit 90 is lower than the maximum transverse dimension of the guiding lug 65. The slit 90 can be widened by elastic deformation of the upper collar 74 to insert the guiding lug 65 into the axial guiding track 72.

The upper transverse region 92 extends circumferentially around axis A-A' in a first circumferential direction D1. The length of transverse region 92 is approximately equal to the maximum transverse dimension of the guiding lug 65.

The upper transverse region 92 extends in the vicinity of the upper collar 74. Its maximal height is advantageously inferior to 1.5 times the height of the guiding lug 65.

The intermediate axial 94 region extends parallel to axis A-A'. Its width is approximately equal to the width of the guiding lug 65. Its height is higher than 50% of the height of the upper tubular wall 66.

The lower transverse region 96 extends from the lower end of the intermediate axial region 94 in a circumferential direction D2 opposite to direction D1.

The circumferential length of the lower transverse region is advantageously lower than three times the maximum transverse dimension of the guiding lug 65.

The lower guiding axial region 98 extends from the free end of the lower transverse region 96. The region 98 is spaced apart and parallel to the intermediate axial region 94. It extends downwardly in an axial direction D3 opposite to the axial region 94.

The height of the lower guiding axial region 98 is higher than the height of the guiding lug 65.

The upper tubular wall 66 also defines several windows 100 which extend through wall 66 above the outer annular step 76.

Figure 6:
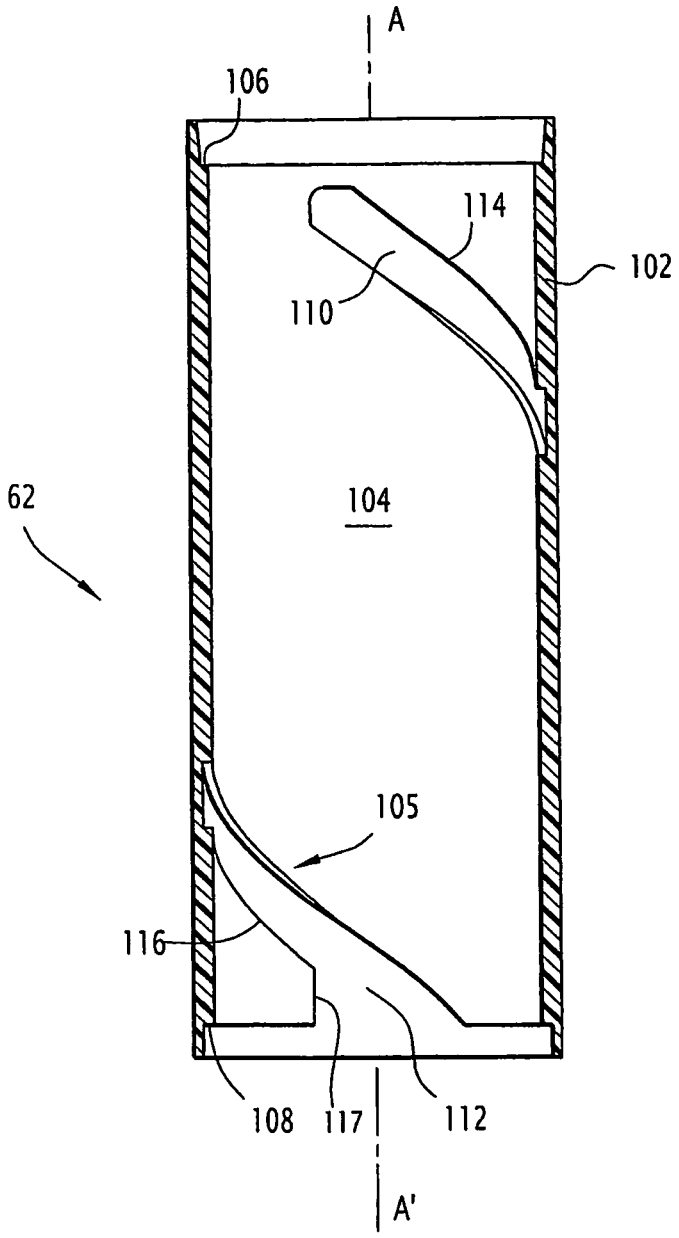
FIG. 6 is a section, taken along an axial median plane, illustrating the outer sleeve of the mechanism of FIG. 3.

As shown in FIGS. 1, 4 and 6, the outer sleeve 62 comprises a peripheral wall 102 defining a through hole 104 for insertion of the inner sleeve 60 and an helical track 105 for guiding the sliding of the cup 64 inside the peripheral wall 102.

The peripheral wall 102 delimits a top inner annular shoulder 106 around its upper edge and delimits a bottom inner annular shoulder 108 around its lower edge.

The height of peripheral wall 102 is approximately equal to the height of the upper tubular wall 66.

The inner surface of the peripheral wall 102 defining the through hole 104 has a shape complementary to the outer surface of the upper tubular wall 66.

The inner sleeve 60 is therefore mounted rotatable around axis A-A' inside the peripheral wall 102. The upper collar 74 is received in the top annular shoulder 106 and the outer annular step 76 is received in the bottom annular shoulder 108.

The helical track 105 is delimited inside the peripheral wall 102. It extends in a helix shape around axis A-A'. The helical track 105 comprises an upper helical region 110 for lifting of the cup 64 inside the lumen 70. According to the invention, the helical track 105 also comprises a lower retention region 112, for axial retention of the cup 64 before its first use.

The track 105 is delimited by a groove defined between an upper helical edge 114 and a lower edge 116. The track 105 opens radially towards the axis A-A'.

The upper region 110 extends over more than 50% of the height of the peripheral wall 102. The helical region 110 extends angularly about an angle above 360° and advantageously above 720° around the axis A-A'.

The minimum width of the upper region 110 is approximately equal to the maximum transverse width of the guiding lug 65. In the upper region 110, both the lower edge 116 and the upper edge 114 are helical.

The lower retention region 112 has a height, taken parallel to the axis A-A', which is higher than the maximum height of the guiding lug 65. The height of the retention region 112 is lower than the height of the lower axial guiding region 98. The lower edge 116 of track 105 in the lower region 112 extends axially and defines an axial abutment portion 117, which is parallel to axis A-A'.

In this example, the lower retention region 112 has a square triangle shape, the square angle of the triangle being defined between the axial abutment portion 117 and the bottom annular shoulder 108.

Figure 7:
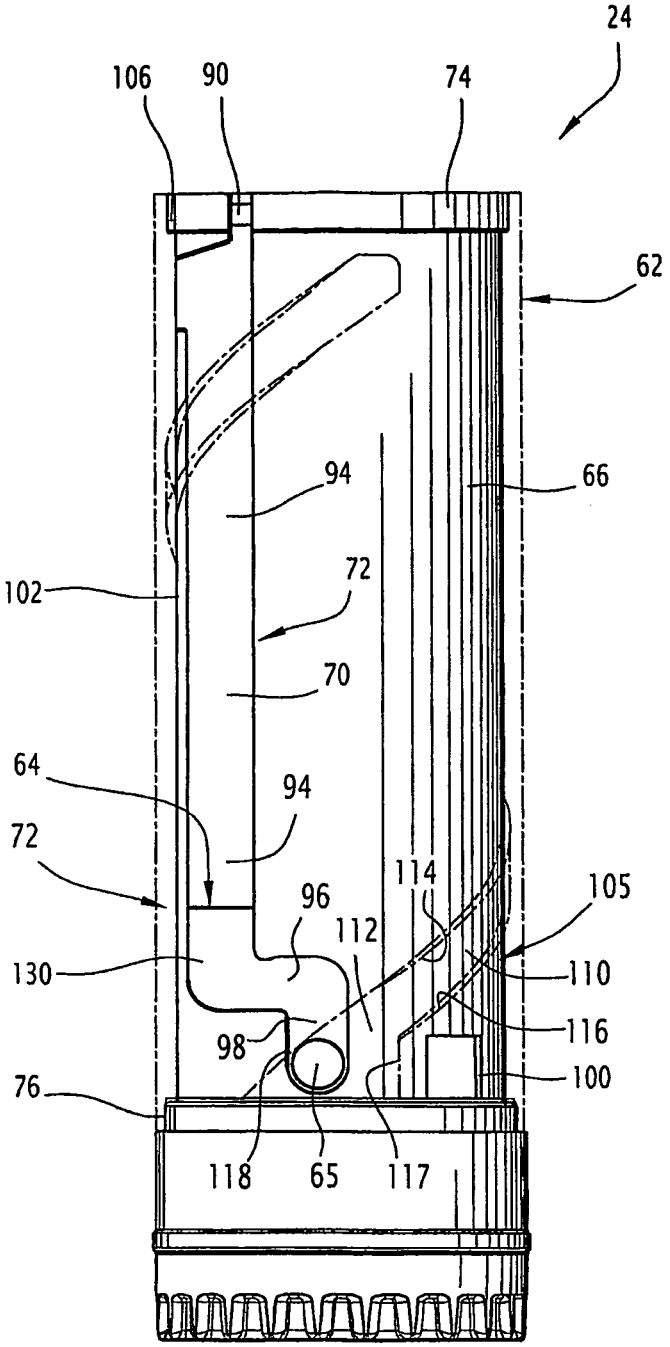
FIG. 7 is a front view, with a transparent outer sleeve, illustrating the mechanism of FIG. 3, the cup being in its initial storage configuration.
Figure 8:
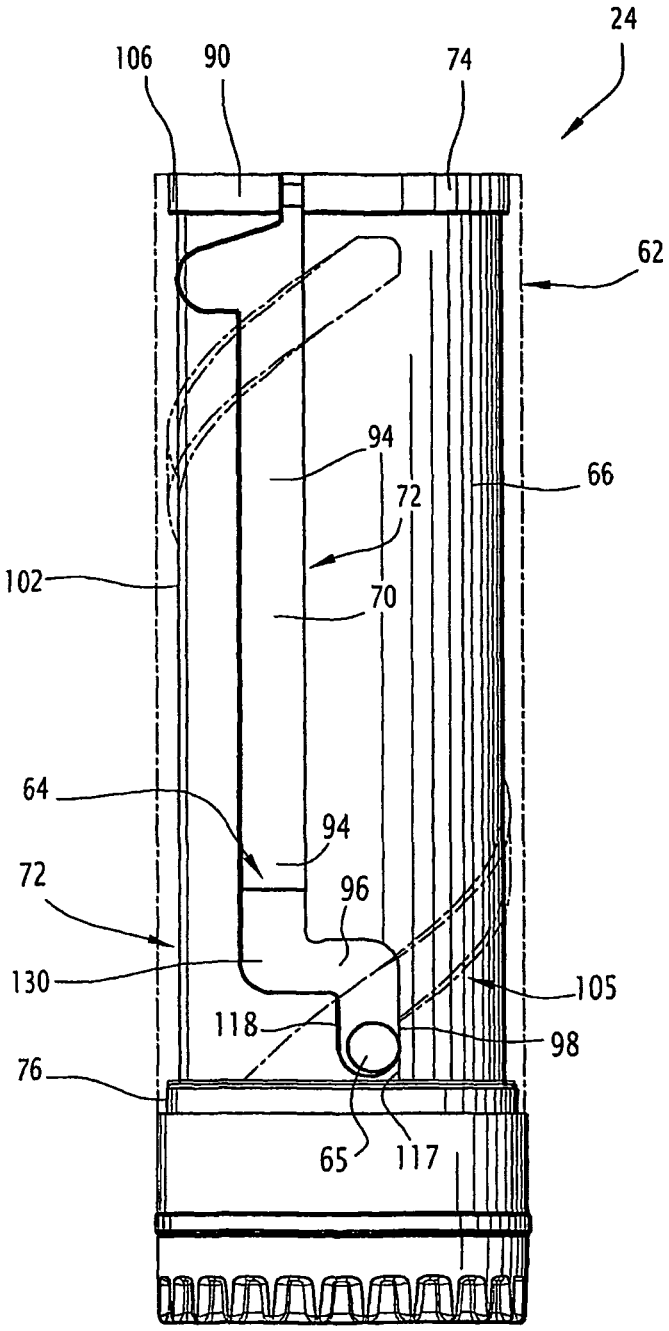
FIG. 8 is a view similar to FIG. 7, in which the outer sleeve and the inner sleeve have been partially rotated.
Figure 9:
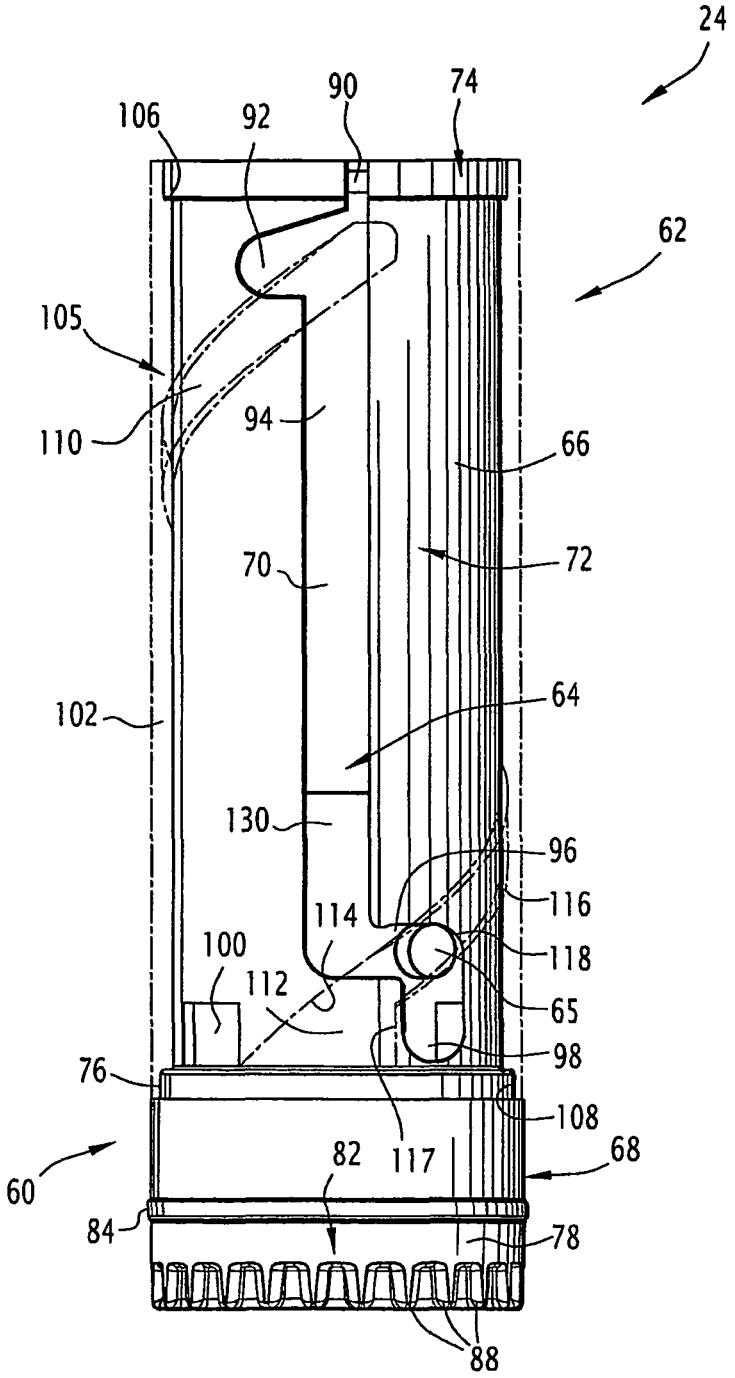
FIG. 9 is a view similar to FIG. 7, after insertion of the mechanism into the hollow base.

The axial guiding track 72 and the helical track 105 are located facing one another in at least an intersecting region 118 visible in FIGS. 7 to 9. This intersecting region 118 moves axially along the axial guiding track 72 upon relative rotation between the inner sleeve 60 and the outer sleeve 62 around axis A-A'.

The cup 64 has a height lower than half the height of lumen 70. The cup 64 comprises an outer peripheral wall 130, a bottom supporting wall 132 and optionally ribs 134 for holding the stick 12.

The outer peripheral wall 130 has an outer surface with a transverse section complementary to the inner section of the lumen 70 to allow the cup 64 to be guided by the inner sleeve 68 when it translates along axis A-A'.

The bottom supporting wall 132 is located in the vicinity of the lower edge of the outer peripheral wall 130. It defines an upper housing 136, which opens upwardly for receiving the stick 12. The bottom supporting wall 132 also defines a lower cavity 138.

The ribs 134 extend radially inside the upper housing 136 from the outer peripheral wall 130 to the bottom supporting wall 132. They have a generally triangle shape.

The guiding lug 65 extends radially with respect to axis A-A'. It protrudes from the outer surface of the peripheral wall 130. In this example, the lug 65 is cylindrical in shape its radial thickness, taken radially from the peripheral wall 130 is approximately equal to the sum of the depth of the axial track 72 and of the depth of the helical track 105.

Its diameter, representing its maximum transverse dimension, is approximately equal to the width of the axial track 72 in the intermediate axial region 94 and is approximately equal to the width of the helical track 105 in the first helical region 110.

As it will be explained below, the cup 64 is axially movable inside the lumen 70 of the inner sleeve 68 between a lower initial configuration, shown in FIG. 4, in which any relative rotation between the inner sleeve 60 and the outer sleeve 62 around the axis A-A' does not induce an axial movement of the cup 64, and an use configuration shown in FIG. 1 from which the cup is slidable within the lumen 70 between an inner retracted position, shown in FIG. 1, and an outer deployed position (not shown), upon relative rotation of the inner sleeve 60 and the outer sleeve 62.

As illustrated in FIG. 7, in the initial configuration, the lug 65 is located in the second retention region 112 of the helical track 105 and at the bottom of the lower axial guiding region 98 of the axial guiding track 72.

In this configuration, the cup 64 is prevented from axially moving along the axis A-A', whatever the angle of relative rotation between the inner sleeve 60 and the outer sleeve 62. Moreover, as shown in FIG. 8, beyond a given angle of rotation of the outer sleeve 62 with respect to the inner sleeve 60, the lug 65 abuts the axial region 117.

In the use configuration, the cup 64 has been pushed axially upwards by the actuating projection 36 towards the inner retracted position.

In this position, the lug 65 has been lifted to the top of the lower axial guiding region 98. The lug 65 is maintained in contact against the upper edge of the helical track 105, above the second retention region 112.

The stick 72 remains totally contained in the lumen 70, without projecting out of the extraction opening 89.

Rotation of the inner sleeve 60 with regard to the outer sleeve 62 beyond a given angle induces a contact of the lug 65 against the inclined lower edge 116 of the helical track 105, which induces a camming effect on the cup 64. The cup 64 is subsequently lifted in the axial track 72 towards the outer position.

In the outer position, the cup 64 has been raised inside the lumen 70 by sliding of the lug 65 inside the first region 110 of the helical track 105, and successively, in the lower transverse region 96, in the intermediate axial region 94 and in the upper transverse region 92.

The cup 64 is located in the vicinity of the upper collar 74 in the lumen 70.

In this upper position, the stick 72 projects out of the lumen 70, which allows its contact with a body surface of a user.

The assembly of the device 10 will be described below.

Initially, the mechanism 24 is assembled. To that aim, the inner sleeve 60, the outer sleeve 62, and the cup 64 are provided separately. The cup 64 is first inserted in the lumen 70 of the inner sleeve 60 through the opening 89 defined by the upper collar 74.

The upper tubular wall 66 is deformed to increase the width of the upper slit 90 and to insert guiding lug 65 into the axial guiding track 72.

The cup 64 is then driven downwards inside lumen 70 by sliding along the axis A-A'. The guiding lug 65 slides down through the intermediate axial region 94, through the lower transverse region 96 and through the lower axial guiding region 98.

Then, the outer sleeve 62 is rotatably mounted around the inner sleeve 60.

The lower end of the outer sleeve 62 is engaged around the upper end of the inner sleeve 60 and the outer sleeve 62 is pushed down until the bottom annular shoulder 108 of the peripheral wall 102 abuts the outer annular step 76 on the lower knob 68. Simultaneously, the upper collar 74 of the upper tubular wall 66 enters the top annular shoulder 106 made in the peripheral wall 102 of the outer sleeve 62.

The outer sleeve 62 is fixed in translation along the axis A-A' with respect to the inner sleeve 60. The outer sleeve 62 is also rotatable around the axis A-A' with respect to the inner sleeve 60.

In this initial configuration of the cup 64, the guiding lug 65 of the cup 64 is located in the retention region 112 of the helical track 105.

As shown in FIG. 8, even if the outer sleeve 62 and the inner sleeve 60 accidentally rotate one with respect to another around the axis A-A', the cup 64 remains in the same axial position due to the configuration of the lower edge 116 and due to the abutment of the guiding lug 65 against the axial portion 117 of the lower edge 116. This is the case for any angular movement of the inner sleeve 60 with respect to the outer sleeve 62.

The stick 12 is then inserted within the cup 64 through lumen 70. The stick 12 is fixed in the cup 64 by insertion of the ribs 134 in its body 14.

The mechanism 24 can then be carried separately from the hollow base 20 without any risk of undesired axial movement of the cup 64 inside the lumen 70.

The stick 12 can be held totally and safely in the lumen 70, until the mechanism 24 is inserted in the hollow base 20, which suppresses the risk of breaking the stick 12 or the risk of pollution during storage of the mechanism 24 for example in a hand bag.

Use of the holding device 10 for applying a cosmetic product on a body surface of a user will be now described.

When needed, the user grabs the mechanism 24 and inserts its lower end into the insertion cavity 30 delimited by the hollow base 20.

The lower knob 68 moves downwardly towards the bottom wall 28 until the teeth 50 located on the inner shoulder 46 enter corresponding notches 88 on the corrugated end of the lower knob 68.

The mechanism 24 is fixed in the insertion cavity 30 by engagement of the retaining elements 34 on and above the annular rib 84 located around the peripheral wall 78 of the knob 68.

During insertion of the lower knob 68 in the cavity 30, the actuating projection 36 enters the lumen 70 through the center opening 86 defined in the transverse bottom wall 80 of the knob 68.

The upper transverse surface 56 of the elongate pin 54 abuts against the bottom supporting wall 132 of the cup 64, which pushes the cup 64 upwardly along the axis A-A' relatively to the inner sleeve 60 and the outer sleeve 62 towards its use configuration.

In the course of the axial movement of the cup 64, the guiding lug 65 slides upwards in the lower axial guiding portion 98 to reach the lower transverse region 96 of the axial guiding track 72.

At the same time, the guiding lug 65 exits the second retention region 112 of the helical track 105 and passes above the axial portion 117 of the lower edge 116. The lug 65 is located in register with the inclined region of the lower edge 116 in the helical region 110 of the helical track 105, as shown in FIG. 9.

The cup 64 occupies its inner retracted position in the lumen 70.

In this position, the user is free to actuate a relative rotation between the outer sleeve 62 and the inner sleeve 60 around axis A-A' to raise the cup 64 towards its outer position.

Accordingly, the user seizes the outer sleeve 62 with fingers of one hand and seizes the hollow base 20 with the fingers of another hand.

The teeth 50 of the gripping elements 32 being engaged in corresponding notches 88 in the lower knob 68, relative rotation of the hollow base 30 with respect to the outer sleeve 62 around the axis A-A' induces a corresponding rotation of the inner sleeve 60.

Beyond a given angle, corresponding to the angular extent of the lower transverse region 96, the rotation moves the intersecting area 118 between the axial guiding track 72 and the helical track 105 upwardly along the axial track 72, which leads to a sliding of the cup 64 towards the upper end of the mechanism 24, by camming effect of the lower inclined edge 116 on the guiding lug 65.

In the course of this movement, the stick 12 projects out of the lumen 70.

When the guiding lug 65 reaches the upper transverse region 92, the cup 64 is locked in its outer deployed position. The user can then apply the external surface of the stick 12 on a body surface to deposit cosmetic product on this body surface.

The user can then retract down the stick 12 and the cup 64 in the mechanism 24 after use, by rotating relatively the inner sleeve 60 and the outer sleeve 62 in an opposite relative direction.

The mechanism 24 is therefore extremely easy to use, once it has been inserted in the hollow base 20.

If needed, the user can remove the mechanism 24 when the stick 12 is depleted or in case the user wishes to change the cosmetic product dispensed by the holding device 10.

In a variation, the axial track 72 does not have a lower transverse region 96. The guiding region 98 extends along the same axis as the main axial region 94.

Upon passage of the cup 64 in its use configuration, the cup 64 is able to be raised in the axial region 94 after a rotation of the inner sleeve 60 with respect to the outer sleeve 62 about an angle which is approximately null.

The terms "a" or "one" must be understood as "at least a" or "at least one" unless the contrary is specified.

The invention claimed is:

1. A mechanism for deploying a stick of cosmetic product, configured to be inserted in a hollow support base, the mechanism comprising:

an inner hollow sleeve having a longitudinal axis;

an outer sleeve rotatably mounted around the inner sleeve, one element among the inner sleeve and the outer sleeve delimiting an helical track, the other element among the inner sleeve and the outer sleeve delimiting an axial track intersecting the helical track;

a cup for holding the stick, the cup having a protrusion engaged in the helical track and in the axial track, the cup being axially movable within the inner sleeve between an inner retracted position and an outer deployed position;

wherein the cup is able to be actuated upon insertion of the mechanism in the hollow base, from an initial configuration, in which the axial movement of the cup between the retracted inner position and the deployed outer position is prevented when the inner sleeve is rotated relative to the outer sleeve about any angle of relative rotation, and a use configuration, in which relative rotation between the inner sleeve and the outer sleeve beyond a given angle of relative rotation induces an axial movement of the cup between the inner retracted position and the outer deployed position;

which further comprises preventing means for preventing the axial displacement of the cup between the inner retracted configuration and the outer deployed position, the preventing means cooperating with the cup in the initial configuration; and wherein the helical track comprises a first helical region in which rotation of the inner sleeve relative to the outer sleeve induces axial displacement of the cup when the protrusion is received in the first region, the preventing means comprising a second retaining region of the helical track in which rotation of the inner sleeve relative to the outer sleeve about any angle of relative rotation maintains the axial position of the cup when the protrusion is received in the second region.

2. The mechanism according to claim 1, wherein the cup is axially movable relative to the inner sleeve and to the outer sleeve along the longitudinal axis between the initial configuration and the use configuration.

3. The mechanism according to claim 1, wherein the helical track is delimited by a lower edge, the lower edge being inclined relative to the longitudinal axis (A-A') in the first region, the lower edge extending approximately axially in the second region.

4. The mechanism according to claim 1, wherein the second region is located at the lower end of the first region.

5. The mechanism according to claim 1, further comprising guiding means for guiding the cup between an initial configuration and an use configuration, wherein the guiding means comprise a guiding region of the axial track able to drive the protrusion from the second region of the helical track to the first region of the helical track when the cup is moved from the initial configuration to an use configuration.

6. The mechanism according to claim 5, wherein the axial track comprises a main axial region extending in a first axial direction, a lower transverse region extending transversely relative to the main axial region, the guiding region extending axially in a second axial direction from the lower transverse region.

7. Mechanism according to claim 1, further comprising guiding means for guiding the cup between an initial configuration and an use configuration.

8. A device for holding a stick of cosmetic product, the device comprising:

a hollow support base defining a cavity;

a mechanism according to claim 1, the mechanism being movable relative to the hollow base between a position apart from the hollow base and a position inserted in the cavity of the hollow base, the cup being actuated between an initial configuration and an use configuration upon insertion of the mechanism in the cavity of the hollow base.

9. The device according to claim 8, wherein the hollow base comprises an actuating projection able to engage one element among the cup, the inner sleeve and the outer sleeve to induce a relative movement between the cup, and at least one of the inner sleeve and the outer sleeve, to actuate the cup from the initial configuration to the use configuration.

10. The device according to claim 9, wherein the actuating projection contacts the cup upon insertion of the mechanism in the hollow base to move the cup between the initial configuration and the use configuration.

11. The device according to claim 8, wherein one among the inner sleeve and the outer sleeve comprises a knob, the hollow base defining an actuating surface able to engage the knob when the mechanism is inserted in the hollow base, the hollow base and the one among the inner sleeve and the outer sleeve being jointly movable in rotation around the longitudinal axis relative to the other among of the inner sleeve and the outer sleeve.

12. The device according to claim 8, further comprising a removable cover engageable on the hollow base, the cover and the hollow base defining an inner space receiving the mechanism.

13. A process for preparing a stick of cosmetic product in order to apply the cosmetic product on a body surface of a user, comprising:

providing a device according to claim 8, the mechanism being in a position apart from the hollow base, the cup being in the initial configuration in which the axial movement between the inner retracted position and the outer deployed position is prevented;

inserting the mechanism in the cavity of the hollow base, the insertion inducing the actuation of the cup from the initial configuration to the use configuration;

relatively rotating the inner sleeve with respect to the outer sleeve around the longitudinal axis to induce an axial sliding of the cup between the inner refracted position and the outer deployed position.

14. The device according to claim 3, wherein the lower edge of the helical track extends approximately axially in the second region so as to define, in the second region, an axial abutment portion for the protrusion of the cup when the inner sleeve is rotated relative to the outer sleeve in the initial configuration.

* * * * *